US006190116B1

(12) United States Patent
Asada

(10) Patent No.: US 6,190,116 B1
(45) Date of Patent: Feb. 20, 2001

(54) SHEET MEDIUM HOLDING DEVICE AND IMAGE FORMING APPARATUS PROVIDED WITH THE DEVICE

(75) Inventor: Tetsuo Asada, Kuwana (JP)

(73) Assignee: Brother Kogyo Kabushiki Kaisha, Nagoya (JP)

( * ) Notice: Under 35 U.S.C. 154(b), the term of this patent shall be extended for 0 days.

(21) Appl. No.: 09/139,717

(22) Filed: Aug. 25, 1998

(30) Foreign Application Priority Data

Aug. 28, 1997 (JP) ..... 9-232585

(51) Int. Cl.[7] ..... B65G 57/00

(52) U.S. Cl. ..... 414/790.7; 414/789.9; 271/207

(58) Field of Search ..... 414/789, 789.1, 414/789.9, 790.7; 270/58.11; 271/207, 213, 214, 216

(56) References Cited

U.S. PATENT DOCUMENTS 2,606,669 * 8/1952 Morrison ..... 414/790.7
3,683,758 * 8/1972 Feldkamper ..... 414/790.7
3,785,256 * 1/1974 Nikkel ..... 414/790.7
3,830,144 * 8/1974 Kuckhermann et al. ..... 414/790.7
3,880,059 * 4/1975 Brockmuller ..... 414/790.7
4,750,853 * 6/1988 Van Soest et al. ..... 271/220
5,342,038 * 8/1994 Suter ..... 414/790.7
5,462,265 * 10/1995 Mandel et al. ..... 414/789.9
5,545,000 * 8/1996 Gorsky ..... 414/790.7
5,569,015 * 10/1996 Gerlier ..... 271/212
5,829,951 * 11/1998 Adami ..... 414/790.7

* cited by examiner

*Primary Examiner*—Douglas Hess
(74) *Attorney, Agent, or Firm*—Oliff & Berridge, PLC

(57) ABSTRACT

The laser printer 1 is provided with a sheet stack portion 5 on which recorded sheets discharged through a discharge port 6 are stacked, and feed rollers 7*b* which slide the stacked sheets so as to move away from the discharge port 6. The laser printer 1 performs the slide of the stacked sheets on the stack portion 5 by detecting the height of the stacked sheets or counting the number of stacked sheets and operating the feed rollers 7*b* based on the detection or count result.

19 Claims, 7 Drawing Sheets

SHEET MEDIUM HOLDING DEVICE AND IMAGE FORMING APPARATUS PROVIDED WITH THE DEVICE

BACKGROUND OF THE INVENTION

1. Field of the Invention

The present invention relates to a device for holding sheet mediums and an image forming apparatus, and more particularly to a sheet medium holding device incorporated in an image forming apparatus such as a copy machine, a facsimile machine, a printer.

2. Description of Related Art

Heretofore, a paper sheet holding device, which is one of a sheet medium holding mechanism, is provided with a sheet stack portion for holding thereon a stack of recorded sheets and an upper and lower side rollers located right before the sheet stack portion in order to feed the recorded sheets one by one onto the sheet stack portion. Those upper and lower side rollers being rotated at a predetermined speed discharge a recorded sheet toward a predetermined position of the sheet stack portion. The discharged sheet is stacked there.

However, when another discharge of a recorded sheet is made after a predetermined volume of the recorded sheets are stacked on the stack portion, the top end of the sheet subsequently discharged hits against the ends of the stacked sheets, causing buckle or slide of the sheet, thus resulting in an irregular stack of the sheets. The higher-level stacked sheets may collapse and are scattered from the stack portion. On the other hand, the sheet stacking portion is desired to hold recorded sheets as much as possible.

SUMMARY OF THE INVENTION

The present invention has been made in view of the above circumstances and has an object to overcome the above problems and to provide a sheet medium holding device which can holds sheet mediums in good order on a sheet stack portion and an image forming apparatus incorporating the sheet medium holding device.

Additional objects and advantages of the invention will be set forth in part in the description which follows and in part will be obvious from the description, or may be learned by practice of the invention. The objects and advantages of the invention may be realized and attained by means of the instrumentalities and combinations particularly pointed out in the appended claims.

To achieve the objects and in accordance with the purpose of the invention, according to a first embodiment of the present invention, there is provided a sheet medium holding device incorporated in an image forming apparatus provided with an image forming section, a sheet discharge portion for discharging a sheet medium on which an image is formed by the image forming section, and a sheet stack portion for sequentially stacking the sheet medium discharged through the sheet discharge portion on a predetermined area of the stack portion, the sheet medium holding device further including a sheet feeding device which is disposed in the sheet stack portion and shifts the stacked sheet mediums from the predetermined area to a position away from the sheet discharge portion at a point of time when the sheet mediums are stacked up to a predetermined amount on the predetermined area of the stack portion.

In the above sheet medium holding device, when the sheet medium discharged from the sheet discharge portion is sequentially stacked on a predetermined area of the sheet stack portion, the sheet feeding device slides a first stack of sheet mediums to a position away from the sheet discharge portion. When the discharge portion further discharges sheet mediums, this second stack of sheet mediums is arranged separately from or partially overlapped on the first stack without hitting against the upstream side end of the first stacked sheet mediums, preventing buckling and sliding of the second stacked sheet mediums.

According to a second embodiment of the present invention, there is provided a sheet medium holding device which holds sheet mediums on a predetermined area of a sheet stack portion, the sheet mediums being discharged from a sheet discharge portion to the sheet stack portion in an image forming apparatus, the sheet medium holding device further including a sheet feeding device which is disposed in the sheet stack portion and shifts the stacked sheet mediums from the predetermined area to a position away from the sheet discharge portion at a point of time when the sheet mediums are stacked up to a predetermined volume on the predetermined area of the stack portion.

According to a third embodiment of the present invention, there is provided an image forming apparatus including a body case, a sheet supply cassette removably attached to the body case, for holding a plurality of sheet mediums in a stacked state, an image forming section which forms an image on the sheet medium supplied from the supply cassette, a sheet discharge portion through which the sheet medium on which the image is formed by the image forming section is discharged to an outside of the body case, a sheet stack portion in which the sheet medium discharged through the sheet discharge portion is sequentially stacked, and a sheet feeding device which is disposed in the sheet stack portion and shifts the stacked sheet mediums from the predetermined area to a position away from the sheet discharge portion at a point of time when the sheet mediums are stacked up to a predetermined volume on the predetermined area of the stack portion.

BRIEF DESCRIPTION OF THE DRAWINGS

The accompanying drawings, which are incorporated in and constitute a part of this specification illustrate an embodiment of the invention and, together with the description, serve to explain the objects, advantages and principles of the invention.

In the drawings.

DETAILED DESCRIPTION OF THE PREFERRED EMBODIMENTS

A detailed description of preferred embodiments of a sheet medium holding device and an image forming apparatus embodying the present invention will now be given taking an example of a laser printer for the image forming apparatus, referring to the accompanying drawings.

Figure 1:
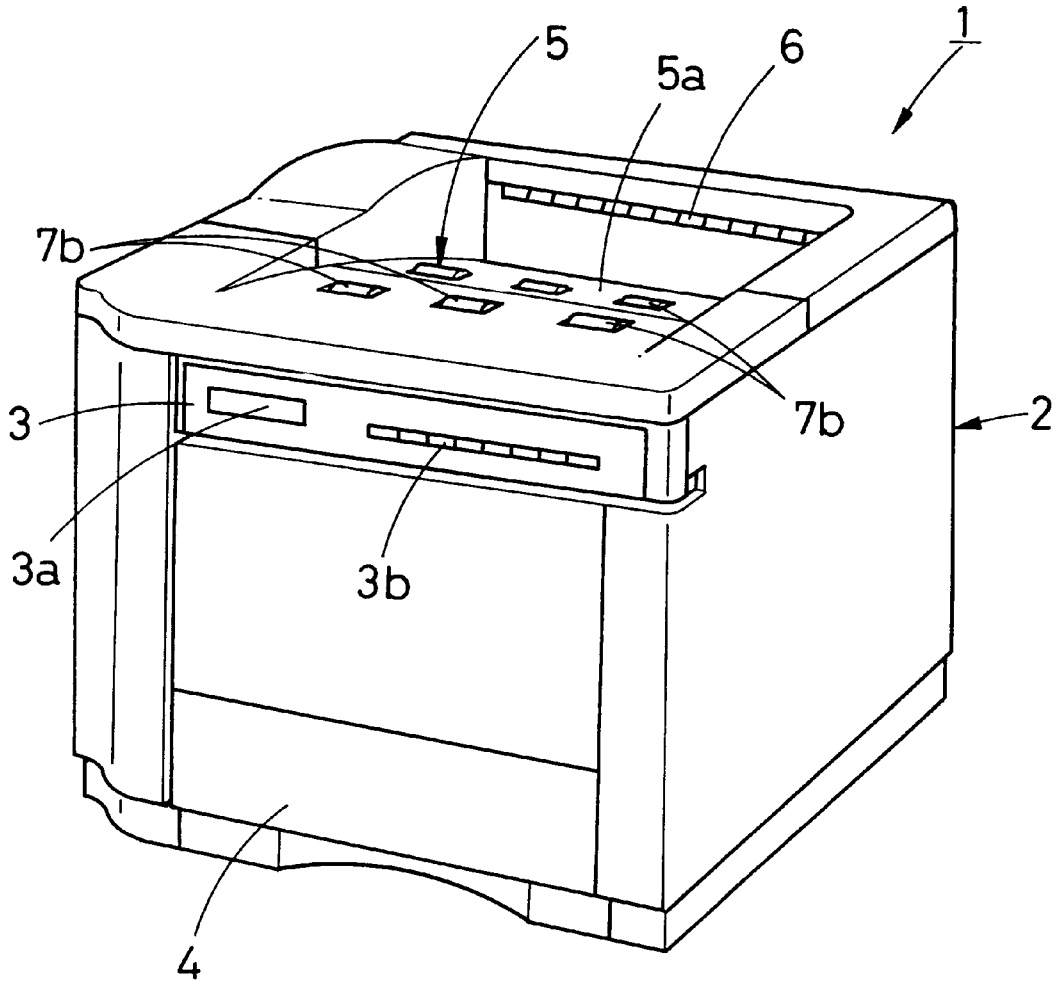
FIG. 1 is a perspective view of an image forming apparatus incorporating a sheet medium holding device in a first embodiment according to the present invention.
Figure 2:
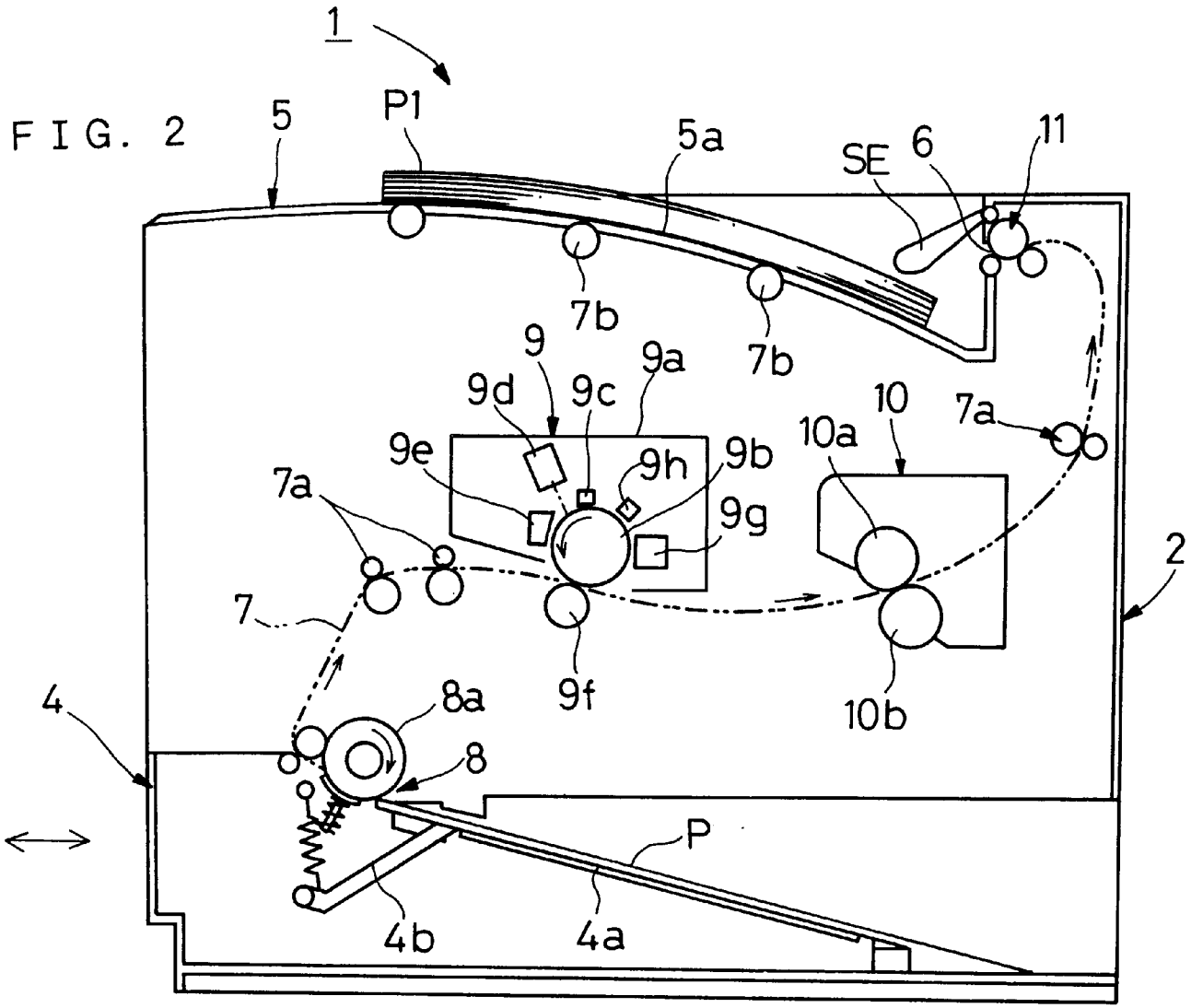
FIG. 2 is a schematic enlarged sectional view of the internal structure of the image forming apparatus.
Figure 3:
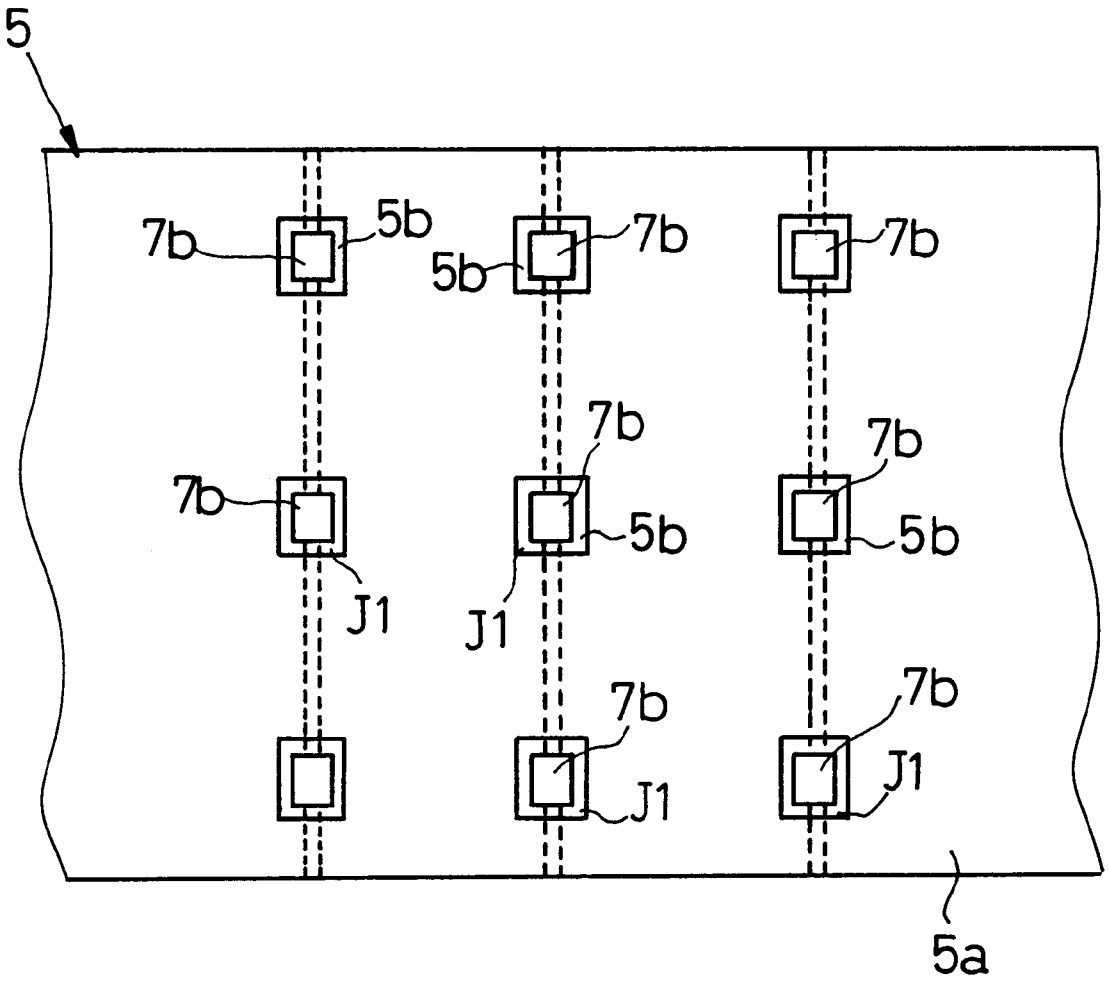
FIG. 3 is an enlarged plane view of a part of a sheet stack section of the image forming apparatus.
Figure 4:
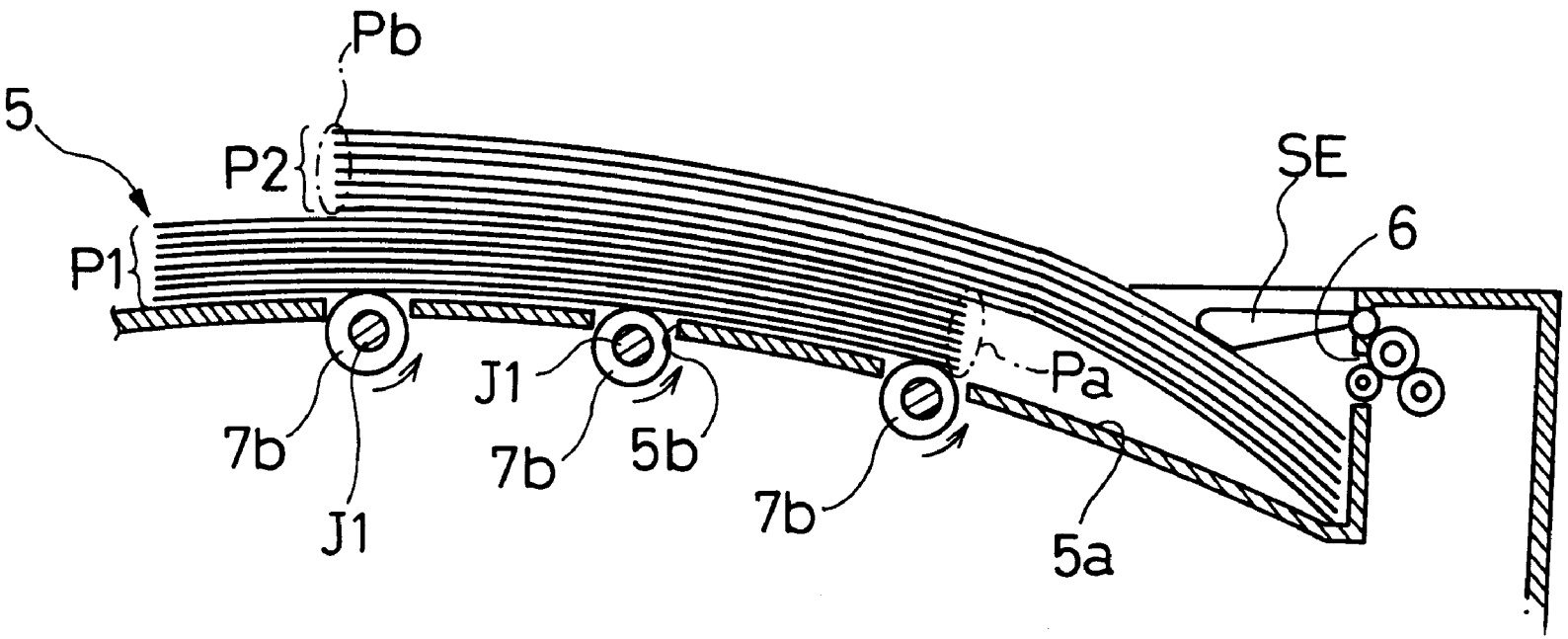
FIG. 4 is an enlarged side view showing a sheet holding state of the image forming apparatus.
Figure 5:
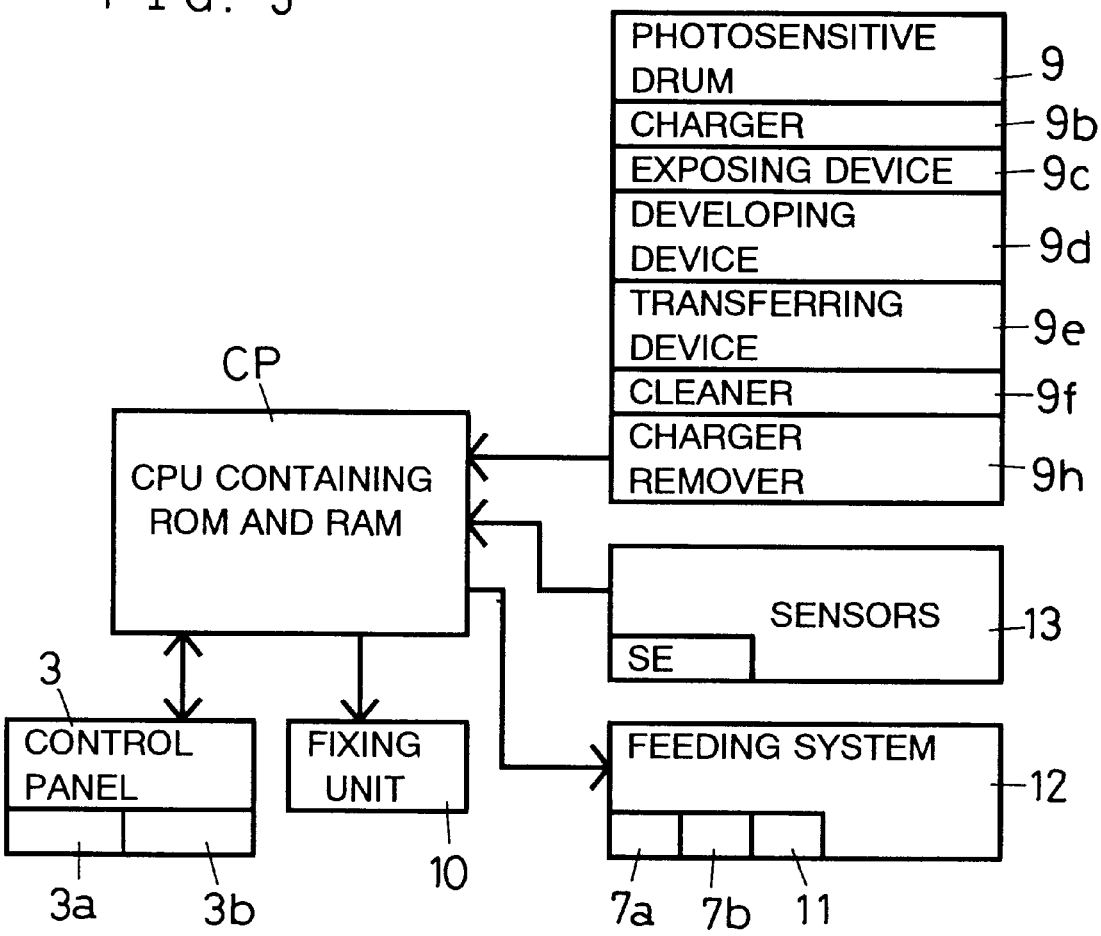
FIG. 5 is a block diagram showing an electrical structure of the image forming apparatus.

A schematic structure of the laser printer in the first embodiment will be first described. FIG. 1 is a perspective view of an image forming apparatus incorporating a sheet medium holding device in the first embodiment. FIG. 2 is a schematic enlarged sectional view of the internal structure of the image forming apparatus. FIG. 3 is an enlarged plane view of a part of a sheet stack portion of the image forming apparatus. FIG. 4 is an enlarged side view showing a sheet holding state of the image forming apparatus.

A laser printer 1 has a box-like body case 2, which is provided with a control panel 3 on its front upper side. The control panel 3 includes a display panel 3*a* and input keys 3*b*. A sheet cassette 4 which holds unused recording sheets (sheet mediums) P is removably set in the body case 2, below the control panel 3. A sheet stack portion 5 for holding a stack of recorded sheets P1 is provided on an upper front side of the body case 2. On an upper rear side of the body case 2 is provided a sheet discharge port 6 through which a recorded sheet P1 is discharged onto the sheet stack portion 5.

A sheet separator 8 is located on a lower front side in the body case 2 as shown in FIG. 2. The sheet separator 8 takes out the uppermost positioned sheet one by one from the sheets P held in the sheet cassette 4 to feed it along a guide path 7. This guide path 7 is defined in the body case 2 with a plurality of feed rollers 7*a* disposed on both sides of the guide path 7. The sheet P is thus fed along the guide path 7 from the sheet cassette 4 to the sheet stack portion 5.

A process unit 9 for an image formation is disposed along the guide path 7 in the body case 2. This process unit 9 forms toner image in accordance with the image data and transfers it onto the sheet P fed from the sheet cassette 4.

A fixing unit 10 is disposed on a downstream side of the process unit 9 in a sheet feed direction along the guide path 7 (referred to as simply a downstream side hereinafter). This fixing unit 10 makes the fixation of toner image transferred on the sheet P. A discharge roller 11 is disposed on a downstream side of the fixing unit 10 in the guide path 7. This discharge roller 11 discharges the toner image fixed sheet P1 out of the body case 2.

In the laser printer 1 in the first embodiment, as mentioned above, the discharge roller 11 disposed on one end of the upper side of the body case 2 discharges the recorded sheet P1 toward another end. The sheet stack portion 5 is formed on the upper surface of the body case 2 which is located on a downstream side in a discharge direction of the recorded sheet P1 by the discharge roller 11.

More specifically, the sheet cassette 4 is set in the body case 2 and it can be pulled from the front side of the body case 2. The sheet cassette 4 is arranged so that, in its set state in the body case 2, a swing arm 4*b* causes a front end (a left end in FIG. 2) of a support plate 4*a* to move upward and contact a separation roller 8*a* of the sheet separator 8. When the separation roller 8*a* as contacting the uppermost positioned sheet P held in the support plate 4*a* is rotated clockwise in FIG. 2, the sheet P is taken out from the sheet cassette 4 and fed along the guide path 7.

The process unit 9 consists of a photosensitive drum 9*b* which is located in the center of a casing 9*a,* and around the photosensitive drum 9*b,* a charger 9*c,* an exposing device 9*d,* a developing device 9*e,* a transfer roller 9*f,* a cleaner 9*g,* a charger remover 9*h,* etc.

The photosensitive drum 9*b* serving as an image bearing body on which a photosensitive layer is formed is arranged so as to be rotatable counterclockwise in FIG. 2. The charger 9*c* charges the photosensitive layer on the photosensitive drum 9*b* at a predetermined potential. The exposing device 9*d* emits a laser beam to the charged photosensitive layer on the photosensitive drum 9*b* to expose it in accordance with image data so that an electrostatic latent image is formed on the photosensitive layer The developing device 9*e* serves to provide toner to the electrostatic latent image formed on the photosensitive drum 9*b* to form a toner image. This developing device 9*e* is internally provided with a developing sleeve not shown disposed close to the photosensitive drum 9*b* such that the rotation of the developing sleeve causes the agitation, circulation, and transport of toner. The transfer roller 9*f* serves to transfer the toner image formed on the drum 9*b* onto the sheet P fed to the process unit 9 by applying an electric field to the photosensitive drum 9*b,* the electric field having an opposite polarity to that applied to the drum 9*b* by the charger 9*c.*

The cleaner 9*g* has a cleaning blade not shown which comes into contact with the surface of photosensitive drum 9*b.* The blade removes the remaining toner on the photosensitive drum 9*b* after the transfer of toner image, whereby to restore the removed toner into the cleaner 9*g.*

Although the transfer roller 9*f* may cause unevenness of potential due to the reversion of the charged polarity on the photosensitive layer of the photosensitive drum 9*b,* the charger remover 9*h* removes the uneven potential part before its arrival at the charger 9*c.*

The fixing unit 10 consists of a heat fixing roller 10*a* and a press roller 10*b* which are disposed in close contact with each other. When those rollers 10*a* and 10*b* presses therebetween the sheet P transported from the process unit 9, the toner is fused in place on the sheet P. By the fusion of toner, the laser printer 1 forms the visual image corresponding to the electrostatic latent image formed on the photosensitive drum 9*b* onto the sheet P. In this embodiment, the process unit 9 and the fixing unit 10 function as image forming section, but the image forming section may be constructed of other elements.

The recorded sheet P1 guided by the feed rollers 7*a* positioned downstream of the fixing unit 10 is fed toward the discharge roller 11 and discharged through the sheet discharge port 6 to the sheet stack portion 5. In this case, when the discharge roller 11 is rotated at a constant speed, the sheet P1 is ejected at a constant speed from the discharge port 6 toward the stack portion 5, and stacked in a predetermined position on the stack portion 5. Consequently, a user can easily take out the recorded sheet P1 held on the stack portion 5, thereby facilitating the handling of recorded sheets P1.

The sheet stack portion 5 is provided with a tilt portion 5*a* formed raising from a lower position below the discharge port 6 toward the downstream side in the sheet feeding direction in order to hold a large number of recorded sheets P1. Accordingly, the recorded sheet P1 discharged from the discharge port 6 is sequentially stacked on the stack portion 5 along the tilt portion 5*a* so that the downstream side end Pb (see FIG. 4) of the sheet is positioned on a raising end side of the tilt portion 5*a.*

In the tilt portion 5*a* of the stack portion 5, there are provided feed rollers 7*b* serving as a sheet feeding device for moving the position of stacked sheets P1 in a direction away from the discharge roller 11. In the present embodiment, the tilt portion 5*a* is provided with a plurality of cutout portions 5*b* (nine cutouts in the embodiment), in each of which a feed roller 7*b* is disposed so that its upper side is partially exposed and put into contact with the sheet P1.

A plurality of feed roller shafts J1 (three shafts in the embodiment) are provided each extending in a direction intersecting the sheet feeding direction in the stack portion 5. On each of the feed roller shaft J1, three feed rollers 7*b* are mounted so as to be integrally rotatable with the shaft J1. When the feed rollers 7*b* are rotated in synchronization with each other, the recorded sheets P1 stacked on the tilt portion 5*a* of the stack portion 5 can be fed downstream in the sheet discharge direction without slipping down.

At this time, the load of the stacked sheets P1 produces so sufficient frictional force between the feed rollers 7*b* and the lowermost positioned sheet P1 and also between the adjacent stacked sheets P1 that the position of the whole stacked sheets P1 be shifted or slid in a direction away from the discharge roller 11 when the feed rollers 7*b* are rotated counterclockwise in FIG. 4. The shifting distance of the sheets P1 in the downstream direction can be determined according to the size of the stack portion 5. In the present embodiment, for example, if a first stack of recorded sheets P1 is slid by a few centimeters or ten and several centimeters in the downstream direction as shown in FIG. 4, a second stack of sheets P2 of the same amount as the first stack of sheets P1 can be stacked on the stack portion 5. In this embodiment, the first stack of sheets P1 can be slid only once in the downstream direction in view of the size of the stack portion 5.

However, if the stack portion 5 is designed remarkably larger than a recorded sheet P1, the second stacked sheets P2 discharged after the slide of the first stacked sheets P1 can be placed in a line without overlapping on the first stacked sheets P1, and the stack of sheets P1 can be slid more than two times in the downstream direction.

When recorded sheets P1 are further discharged on the stack portion 5 after the slide of the first stacked sheets P1, the stack portion 5 holds thereon the second stack of discharged sheets P2 such that they are laid to partially overlap the first stacked sheets P1 as shown in FIG. 4. Here, since the second stacked sheets P2 are discharged from above the first stacked sheets P1, overlapping the upstream side part of the first stacked sheets P1, the second stacked sheets P2 do not come into contact with the upstream side ends Pa of the first stacked sheets P1. This can prevent buckling and sliding of the first stacked sheets P1 or the second stacked sheets P2.

For detecting the height (amount) of the stacked sheets on the stack portion 5, for example, a contact type sensor SE is provided near the sheet discharge port 6. This sensor SE detects the height of the stacked sheets on the stack portion 5 by contacting the uppermost stacked sheet. In this came, the maximum height of the sheets P1 is determined in advance so that the sensor SE comes into contact with the uppermost sheet when 250 and 500 A4-sized sheets are stacked, for example. Accordingly, the sensor SE constitutes a detector for detecting the amount of stacked sheets (sheet-like mediums) P1, and the sensor SE may be any other type of sensors instead of the contact-type sensor.

A controller CP of the laser printer 1 including a central processing unit (CPU) forming the core is connected to the control panel 3 serving as input unit, a feed system 12 which controls the rotation of the feed rollers 7*a* and 7*b* and the discharge roller 11, sensors 13 including the process unit 9 consisting of the charger 9*c,* the exposing device 9*d,* the developing device 9*e,* the transfer roller 9*f,* the cleaner 9*g,* and the charger remover 9*h,* and the fixing unit 10. Those devices or units transmit/receive signals to/from the controller CP and, especially, the sensor SE transmits a detection signal representative of the height of the stacked sheets P1 on the stack portion 5 to the controller CP. The controller CP contains the CPU, a read only memory (ROM), and a random-access memory (RAM).

The ROM stores a control program for the process unit 9, and other various programs needed for operations of the laser printer 1. The RAM has various data storage areas, e.g., a print buffer, in which image data to be used for the formation of electrostatic latent image is provisionally stored.

Figure 6:
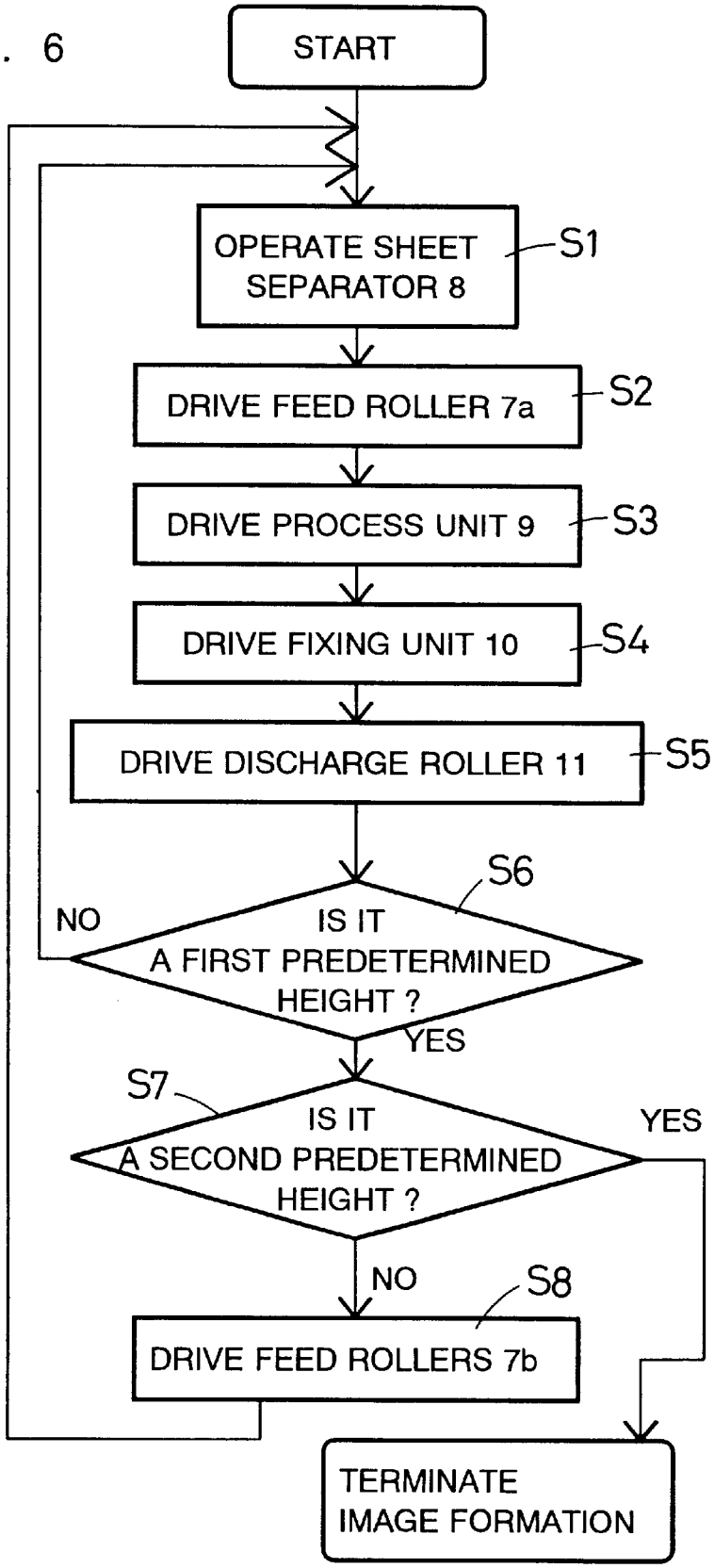
FIG. 6 is a flowchart showing a drive operation of the image forming apparatus in the first embodiment.

Next, the operation of the laser printer 1 will be explained with reference to FIG. 6, where each step in the flow chart is abbreviated as "S".

In the present embodiment, the sensor SE detects the height (amount) of the sheets discharged after printing and held on the stack portion 5, and the controller CP (controller) controls the operation of the feed rollers 7*b,* i.e., the sheet feeding amount by the feed rollers 7*b* in accordance with the detection result of the sensor SE.

The controller CP of the laser printer 1 activates the sheet separator 8 (S1) and then activates the feed rollers 7*b* (S2). The separator 8 takes out the uppermost one of the sheets P held in the sheet cassette 4 to feed it along the guide path 7.

The controller CP drives the process unit 9 to form a toner image (S3) and, after the image formation, drives the fixing unit 10 to fix the toner image on the sheet P (S4). Subsequently, the controller CP drives the discharge roller 11 to discharge the printed sheet P1 onto the stack portion 5 (S5).

Then, when the sensor SE detects the height of the stacked sheets P1 on the stack portion 5, the controller CP determines whether or not the detected height of the stacked sheets P1 is a predetermined height (a first height), for example, the height is of 250 stacked sheets (S6). When the detection result is not the predetermined height (S6: NO), the controller CP repeats the operations of the steps S1 to S5. The recorded sheet P1 is stacked in sequence on the stack portion 5.

When it is the predetermined height (which is the height of 250 stacked A4-sized sheets) (S6: YES), the controller CP determines whether or not the detected height is the second predetermined height, namely, the height of 500 stacked A4-sized sheets (S7). When it is not the second predetermined height (S7: NO), the controller CP operates the feed rollers 7*b* to slide the stacked sheets P1 in the downstream direction (S8). After the sliding, the controller CP repeats the steps S1 to S6.

In this way, all of the stacked sheets P1 are slid downstream in the sheet discharge direction as shown in FIG. 4. Subsequently, another sheets constituting the second stack are discharged to be held on the stack portion 5 so that the second stacked sheets P2 are laid to partially overlap the first stacked sheets P1. Thus, the stack portion 5 can hold A4-sized sheets corresponding to twice the height of 250 sheets, namely, up to 500 sheets. The second stacked sheets P2 arranged as mentioned above hardly buckle and slide, so that a large amount of the stacked sheets P1 can be stacked in good order on the stack portion 5. The so stacked sheets hardly collapse.

When the detected height is the second predetermined height (S7; YES), the controller CP terminates the image forming operation. In other words, the stack portion 5 can not hold sore than 500 sheets, 80 that the image forming operation is completed when the sensor SE detects that the second stacked sheets P2 reaches the second height on the stack portion 5.

Figure 7:
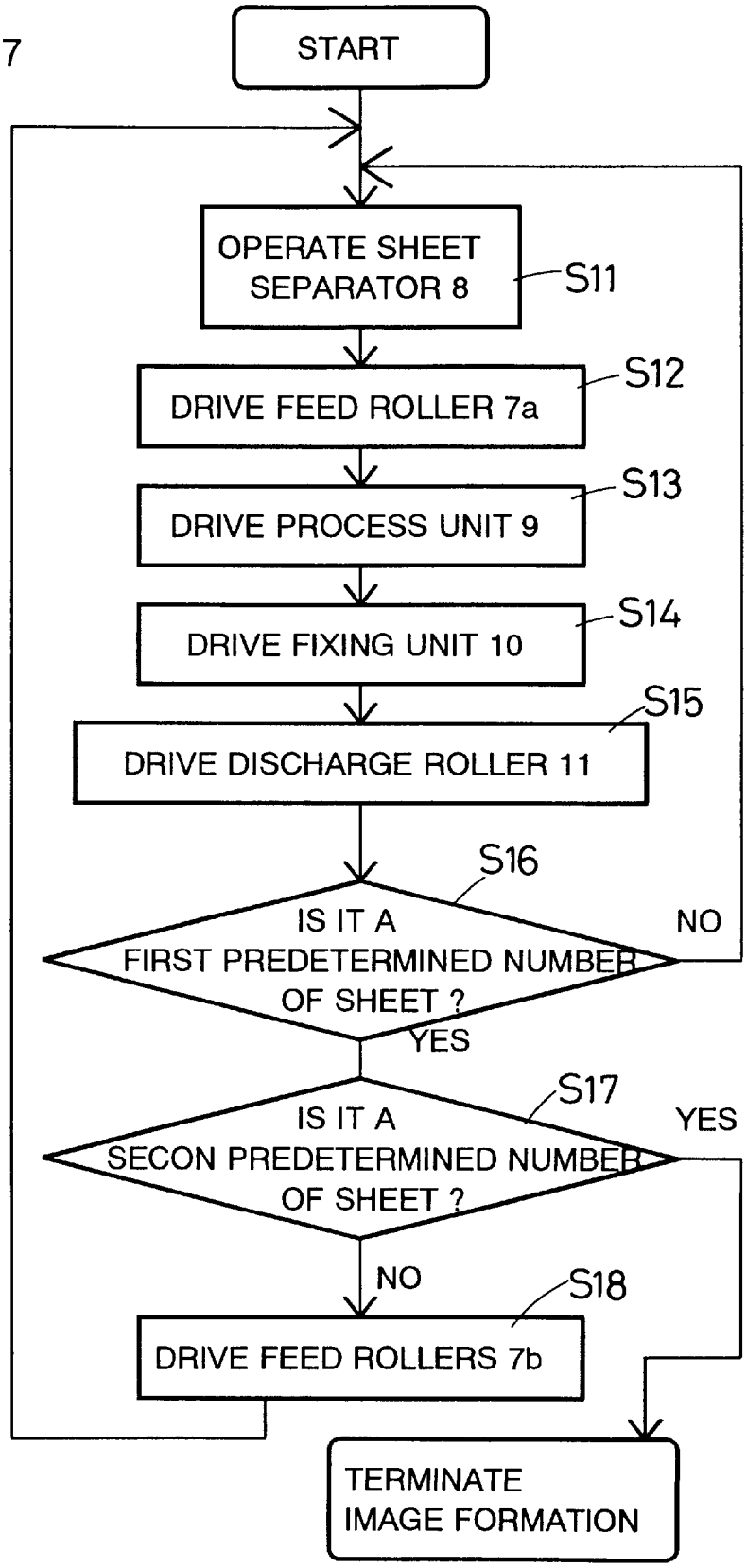
FIG. 7 is a flowchart showing a drive operation of the image forming apparatus in a second embodiment.

Next, the operation of the laser printer 1 in the second embodiment will be described, referring to the flow chart of FIG. 7. In the second embodiment, instead of detection on the height (amount) of the discharged recorded sheets P1 on the stack portion 5, the controller CP counts the number of sheets discharged to the stack portion 5 and, based on the counted result, controls the feed rollers 7 to operate, namely, the shoot feeding amount. This embodiment adopts the method of counting the number of recorded sheets P1 discharged onto the stack portion 5 by detecting the image forming operation of the process unit 9. The controller CP serves as a counter which counts the number of discharged sheets onto the stack portion 5. The counter may be provided separately from the controller CP.

In the second embodiment, the steps S11 to S15 executed by the controller CP of the laser printer 1 are the same as the steps S1 to S5 in the first embodiment, and the description of the steps S11 to 515 is omitted.

The controller CP judges in S16 whether the number of recorded sheets discharged onto the stack portion 5 is the first predetermined number, e.g., 250. When it is not the predetermined number (S16: NO), the controller CP repeats the steps S11 to S15. Thus, the recorded sheets P1 are stacked one by one on the stack portion 5 during the steps S11 to S15.

When it is the first predetermined number (S16: YES), the controller CP judges in S17 whether the number of discharged sheets is the second predetermined number, i.e., 500 which is twice the first predetermined number (250). When it is not the second predetermined number (S17: NO), the controller PC operates the feed rollers 7*b* to slide the first stack of recorded sheets P1 in a downstream direction (S18). The controller CP then repeats the steps S11 to S17. Accordingly, after all of the stacked sheets P1 are slid downstream by a predetermined distance in the discharging direction, the second stack of recorded sheets P2 can be held on the stack portion 5 as shown in FIG. 4.

Consequently, the second stacked sheets P2 held partially overlapping the first stacked sheets P1, so that the stack portion 5 can hold twice the amount of the sheets P1, for example, twice 250 sheets. When it is the predetermined second number of sheets (S17: YES), the controller CP terminates the image forming operation. In the present embodiment, the first stack of sheets P1 can be slid only once in the downstream direction in view of the size of the stack portion 5; however, the position of the sheets P1 may be slid over several times in the downstream direction. In the embodiment, the controller CP may control as appropriate the driving amount of the feed rollers 7*b* to divide the stacked sheets P1 per a predetermined number or per a predetermined height.

As mentioned above in detail, in the second embodiment of the laser printer 1 having a sheet medium holding device for holding the recorded sheet P1 at a predetermined position on the stack portion 5, this stack portion 5 is provided with the feed rollers 7*b* for sliding the recorded sheets P1 held at the predetermined position in the direction away from the sheet discharge port 6. Accordingly, when the recorded sheets P1 are stacked at the predetermined position, the position of the sheets P1 can be slid by the feed rollers 7 in the direction away from the sheet discharge port 6. When the sheet medium holding device further holds the second stack of the recorded sheets P2, which is arranged overlapping a part of the first stack of the recorded sheets P1. At this time, the downstream side ends Pb of the second stacked sheets P2 are prevented from contacting the upstream side end Pa of the first stacked sheets P1, thus preventing the buckling and sliding of the second stacked sheets P2.

The laser printer 1 in the second embodiment is provided with the body case 2, the process unit 9 and the fixing unit 10 which are disposed in the body case 2 to form an image on the sheet P, the discharge roller 11 which discharges the recorded sheet P1 on which the image is formed toward the outside of the body case 2, the sheet stack portion 5 which holds the recorded sheet P1 discharged by the discharge roller 11, the feed rollers 7*b* which are arranged in the sheet stack portion 5 and feed the recorded sheets P1 held on the sheet stack portion 5 in the downstream side of the sheet discharging direction.

Accordingly, the position of first stacked recorded sheets P1 is shifted by the feed rollers 7 in the downstream direction and then the recorded sheet constituting the second stack of sheets P2 is discharged by the discharge roller 11, so that the top ends Pa of the second stacked sheets P2 discharged following the slide of the first stacked sheets P1 do not buckle and slide. Thus, the is recorded sheets P1 and P2 can be held in good order in a large volume.

The present invention may be embodied in other specific forms without departing from the spirit or essential characteristics thereof. For instance, the controller CP may be adopted so as to perform at the same time both of the detection of the height (amount) of the recorded sheets P1 (P2) discharged onto the stack portion 5 and the count of the number of discharged sheets P1 (P2) onto the stack portion 5 to control the operation of the feed rollers 7*b* based on the detection and count result, or only one of the above detection and count operations.

The sheet feeding device may consist of, instead of the feed rollers 7*b* disposed in the sheet stack portion 5, for example, a sheet feeding plate or belt which is disposed on a bottom of the sheet stack portion 5 to feed the stacked sheets P1 in the downstream direction. It is to be noted that the sheet feeding device may consist of a different structure from the above feed roller, feeding plate, and feeding belt.

The image forming apparatus of the present invention is not limited to the laser printer in the embodiment and may be applied to, for example, a printer such as a thermal printer, a copy machine, a facsimile machine, and other printers. The sheet medium is also not limited to recording paper and may be different medium, e.g., a transparent OHP film.

The foregoing description of the preferred embodiment of the invention has been presented for purposes of illustration and description. It is not intended to be exhaustive or to limit the invention to the precise form disclosed, and modifications and variations are possible in light of the above teachings or may be acquired from practice of the invention. The embodiment chosen and described in order to explain the principles of the invention and its practical application to enable one skilled in the art to utilize the invention in various embodiments and with various modifications as are suited to the particular use contemplated. It is intended that the scope of the invention be defined by the claims appended hereto, and their equivalents.

What is claimed is:

1. A sheet medium holding device in combination with an image forming apparatus provided with an image forming section, a sheet discharge portion through which sheet mediums on which an image is formed by the image forming section are discharged, and a sheet stack portion that sequentially stacks the sheet mediums discharged through the sheet discharge portion on a predetermined area of the stack portion, the sheet medium holding device comprising:

a sheet feeding device which is disposed in the sheet stack portion and shifts a stack of sheet mediums from the predetermined area to a position away from the sheet discharge portion and within the sheet stack portion such that a subsequently fed sheet medium partially overlaps the stack of the sheet mediums;

wherein the sheet stack portion is formed with a tilt portion raising upward to a downstream side in a direction along which the sheet medium is shifted by the sheet feeding device;

wherein the tilt portion is provided with at least one cutout portion, and the sheet feeding device comprises at least one sheet feed roller disposed in the at least one cutout portion such that a portion of each at least one roller is exposed from the at least one cutout portion, and wherein the at least one sheet feed roller shifts the sheet mediums stacked on the tilt portion.

2. A combination according to claim 1, further comprising a sheet discharge roller disposed close to the sheet discharge portion, the roller being rotated at a constant speed, wherein the sheet medium is discharged by the sheet discharge roller to the sheet stack portion and stacked on the predetermined area.

3. A combination according to claim 1, further comprising:

a detector which detects an amount of the sheet mediums stacked on the sheet stack portion, the detector being arranged adjacent to the sheet discharge portion downstream along a sheet discharge direction; and a controller which drive-controls the sheet feeding device on a basis of a detection result by the detector, wherein the sheet feeding device shifts the stack of sheet mediums from the predetermined area to the position away from the sheet discharge portion within the sheet stack portion when the detector detects that the sheet mediums are stacked up to a predetermined amount on the predetermined area of the sheet stack portion.

4. A combination according to claim 3, wherein the detector comprises a contact-type sensor which is disposed close to the sheet discharge portion and detects a height of the stacked sheet mediums on the sheet stack portion by contacting an uppermost one of the stacked sheet mediums.

5. A combination according to claim 4, wherein the contact-type sensor detects a first and second height of the stacked sheet mediums on the sheet stack portion, the second height being higher than the first height.

6. A combination according to claim 5, wherein the controller drives the sheet feeding device to feed the stacked sheet mediums on the sheet stack portion when the contact-type sensor detects the first height and does not detect the second height.

7. A combination according to claim 6, wherein the controller causes the image forming section to stop an image forming operation when the contact-type sensor detects the second height.

8. A combination according to claim 3, wherein the detector comprises a counter which counts a number of sheet mediums discharged from the sheet discharge portion to the sheet stack portion.

9. A combination according to claim 8, wherein the counter counts a first and second number of sheet mediums discharged to the sheet stack portion, the second number being larger than the first number.

10. A combination according to claim 9, wherein the controller drives the sheet feeding device to feed the stacked sheet mediums on the sheet stack portion when the counter counts the first number of discharged sheet mediums and does not detect the second number.

11. A combination according to claim 10, wherein the controller causes the image forming section to stop an image forming operation when the counter counts the second number of discharged sheet mediums.

12. A sheet medium holding device which sequentially receives sheet mediums from a sheet discharge opening and holds the sheet mediums on a predetermined area of a sheet stack device, the sheet medium holding device comprising:

a sheet feeding device which is disposed in the sheet stack device and shifts a stack of sheet mediums from the predetermined area to a position away from the sheet discharge opening and within the sheet stack device such that a subsequently fed sheet medium partially overlaps the stack of sheet mediums;

a detector which detects an amount of the sheet mediums stacked on the sheet stack device, the detector being arranged adjacent to the sheet discharge opening downstream along a sheet discharge direction; and a controller which drive-controls the sheet feeding device on a basis of a detection result by the detector;

wherein the sheet feeding device shifts the stack of sheet mediums from the predetermined area to the position away from the sheet discharge portion within the sheet stack portion when the detector detects that the sheet mediums are stacked up to a predetermined amount on the predetermined area of the sheet stack portion.

13. A sheet medium holding device according to claim 12, wherein the detector comprises a contact-type sensor which is disposed close to the sheet discharge opening and detects a height of the stacked sheet mediums on the sheet stack device by contacting an uppermost one of the stacked sheet mediums.

14. A sheet medium holding device according to claim 13, wherein the contact-type sensor detects a first and second height of the stacked sheet mediums on the sheet stack device, the second height being higher than the first height.

15. A sheet medium holding device according to claim 14, wherein the controller drives the sheet feeding device to feed the stacked sheet mediums on the sheet stack device when the contact-type sensor detects the first height and does not detect the second height.

16. A sheet medium holding device according to claim 12, wherein the detector comprises a counter which counts a number of sheet mediums discharged from the sheet discharge opening to the sheet stack device.

17. A sheet medium holding device according to claim 16, wherein the counter counts a first and second number of sheet mediums discharged to the sheet stack device, the second number being larger than the first number.

18. A sheet medium holding device according to claim 17, wherein the controller drives the sheet feeding device to feed the stacked sheet mediums on the sheet stack device when the counter counts the first number of discharged sheet mediums and does not detect the second number.

19. A sheet medium holding device according to claim 12, wherein the sheet stack device is formed with a tilt portion raising upward to a downstream side in a direction along which the sheet medium is shifted by the sheet feeding device.

* * * * *